US005879474A

United States Patent [19]

Bhadeshia et al.

[11] Patent Number: 5,879,474

[45] Date of Patent: Mar. 9, 1999

[54] RELATING TO CARBIDE-FREE BAINITIC STEELS AND METHOD OF PRODUCING SUCH STEELS

[75] Inventors: Harshad Kumar Dharamshi Hansraj Bhadeshia, Cambridge; Vijay Jerath, South Yorkshire, both of England

[73] Assignee: British Steel plc, England

[21] Appl. No.: 860,730

[22] PCT Filed: Jan. 11, 1996

[86] PCT No.: PCT/GB96/00034

§ 371 Date: Sep. 29, 1997

§ 102(e) Date: Sep. 29, 1997

[87] PCT Pub. No.: WO96/22396

PCT Pub. Date: Jul. 25, 1996

[30] Foreign Application Priority Data

Jan. 20, 1995 [GB] United Kingdom ..... 9501097

[51] Int. Cl.[6] ..... C21D 8/00; C21D 9/04; C22C 38/18

[52] U.S. Cl. ..... 148/333; 148/581; 420/103

[58] Field of Search ..... 148/581, 333; 420/103, 104

[56] References Cited

U.S. PATENT DOCUMENTS 3,915,697 10/1975 Lucio et al. .

FOREIGN PATENT DOCUMENTS

| | | |
|---|---|---|
| 0 612 852 | 8/1994 | European Pat. Off. . |
| 23 02 865 | 7/1974 | Germany . |
| 331 618 | 9/1958 | Switzerland . |
| 1 131 662 | 10/1968 | United Kingdom . |
| 2 182 675 | 5/1987 | United Kingdom . |

OTHER PUBLICATIONS

Patent Abstracts of Japan, vol. 94, No. 011 & JP,A,06, 316728 (Nippon Steel Corp.), 15 Nov. 1994.

Stahl und Eisen, vol. 115, No. 2, 16 Feb. 1995, pp. 93–98, 138, XP00496383 Dor de H. et al.: "Naturharte Bainitische Schienen Mit Hoher Zugfestigkeit".

*Primary Examiner*—Deborah Yee
*Attorney, Agent, or Firm*—Bacon & Thomas, PLLC

[57] ABSTRACT

A method of producing a wear and rolling contact fatigue resistant bainitic steel product whose microstructure is essentially carbide-free. The method comprises the steps of hot rolling a steel whose composition by weight includes from 0.05 to 0.50% carbon, from 1.00 to 3.00% silicon and/or aluminum, from 0.50 to 2.50% manganese, and from 0.25 to 2.50% chromium, balance iron and incidental impurities, and continuously cooling the steel from its rolling temperature naturally in air or by accelerated cooling.

9 Claims, 8 Drawing Sheets

×5000

RELATING TO CARBIDE-FREE BAINITIC STEELS AND METHOD OF PRODUCING SUCH STEELS

BACKGROUND OF THE INVENTION

1. Field of the Invention

This invention relates to carbide-free bainitic steel rails and to methods of producing such steel rails. More especially, but not exclusively, the invention relates to carbide-free bainitic steels having enhanced wear resistance and rolling contact fatigue from which inter alia track and crane rails, railway points and crossings.

2. Description of Related Art

Most track rails have hitherto been produced from pearlitic steels. Recent reviews have indicated that pearlitic steels are approaching the limit of their material property development for track rails. There is therefore a need to evaluate alternative types of steel having good wear and rolling contact fatigue resistance coupled with improved levels of ductility toughness and weldability.

EP 0612852A1 discloses a process for manufacturing high-strength bainitic steel rails having good rolling-contact fatigue resistance in which the head of the hot-rolled rail is subjected to a discontinuous cooling programme which entails accelerated cooling from the austenite region to a cooling stop temperature of 500° to 300° C. at a rate of 1° to 10° C. per second, and then cooling the rail head further to a still lower temperature zone. The bainitic steel from which the rails are produced is not carbide-free. Rails produced by this process were found to wear away more readily than conventional pearlitic rails and exhibited an improved resistance to rolling-contact fatigue. Thus, the increase in wear rate exhibited by the head surfaces of these rails ensured that accumulated fatigue damage wore away before defects occurred. The physical properties exhibited by these rails are achieved in part by the accelerated cooling regime referred to above.

The solution proposed by EP 0612852A1 differs markedly to the method of the present invention which achieves in rail steels substantially enhanced wear resistance with excellent resistance to rolling-contact fatigue. These steels also show improved impact toughness and ductility in comparison with pearlitic rails. The method of the present invention also avoids the need for a complicated discontinuous cooling regime as specified in EP 0612852A1.

Other similar documents specifying complicated discontinuous cooling regimes include GB 2132225, GB 207144, GB 1450355, GB 1417330, U.S. Pat. No. 5,108,518 and EP 0033600.

Track rails produced from iron carbide containing bainitic steels have been proposed previously. Whereas the fine ferrite lath size (~0.2–0.8 $\mu$m wide) and high dislocation density of continuously cooled bainite combine to make the steels very strong, the presence in the microstructure of inter and intralath carbides leads to increased embrittlement which has to a large extent tended to hinder commercial exploitation of such steels.

It is known that the embrittlement problem which occurs because of the presence of deleterious carbides can be largely alleviated by employing relatively large silicon and/or aluminium additions (~1–2%) to low-alloy steels. The presence of silicon and/or aluminium steels continuously transformed to bainite encourages the retention of ductile high carbon austenite regions in preference to the formation of brittle intralath cementite films, and depends on the premise that the dispersed, retained austenite should be both thermally and mechanically stable. It has been shown that the retained austenite following continuous cooling transformation in the bainitic temperature range occurs either as finely divided thin intralath films, or in the form of "blocky" interpacket regions. While the thin film morphology has extremely high thermal and mechanical stability, the blocky type can transform to high carbon martensite, less conducive to good fracture toughness. A ratio of thin film to blocky morphology >0.9 is required to ensure good toughness, and this can be achieved through a careful choice of steel composition and heat treatment. This results in an essentially carbide free, "upper bainite" type microstructure based on bainitic ferrite, residual austenite and high carbon martensite.

SUMMARY OF THE INVENTION

It is an object of the present invention to provide carbide-free bainitic steels with substantially enhanced ranges of hardness, and which exhibit clear advantages over known track rail steels.

According to the present invention in one aspect there is provided a method of producing a wear and rolling contact fatigue resistant carbide-free bainitic steel rail, the method comprising the steps of hot rolling to shape a steel whose composition by weight includes from 0.05 to 0.50% carbon, from 1.00 to 3.00% silicon and/or aluminium, from 0.50 to 2.50% manganese, from 0.25 to 2.50% chromium, from 0 to 3.00% nickel; from 0 to 0.025% sulphur; from 0 to 1.00% tungsten; from 0 to 1.00% molybdenum; from 0 to 3% copper; from 0 to 0.10% titanium, from 0 to 0.50% vanadium; and from 0 to 0.005% boron, balance iron and incidental impurities, and continuously cooling the rail from its rolling temperature to ambient temperature naturally in air or by accelerated cooling.

The carbon content of preferred steel compositions may be from 0.10 to 0.35% by weight. The silicon content may be from 1.00 to 2.50% by weight. Also the manganese content may be from 1.00% to 2.50% by weight, chromium content may be between 0.35 and 2.25% by weight and the molybdenum content may be from 0.15 to 0.60% by weight.

Steels in accordance with the invention exhibit improved levels of rolling contact fatigue strength, ductility, bending fatigue life and fracture toughness, coupled with rolling contact wear resistance similar to or better than those of the current heat treated pearlitic rails.

Under certain circumstances it is considered advantageous for the rail to possess an adequately high wear rate in order to allow the accumulated rolling contact fatigue damage on the surface of the rail head to be continually worn away. One obvious way to increase the wear rate of the rail is by decreasing its hardness. A significant reduction in the hardness of the rail, however, causes severe plastic deformation to occur on the surface of the rail head, which in itself is undesirable.

The novel solution to this problem lies, therefore, in being able to produce a sufficiently high hardness/strength rail to resist excessive plastic deformation during service, thereby maintaining the desired rail shape, yet possessing a reasonably high wear rate for continual rolling contact fatigue damage removal. This has been achieved in the present invention by the deliberate introduction in a carbide free bainitic microstructure of a small proportion of soft proeutectoid ferrite, through an appropriate adjustment to the steel composition.

One processing advantage of the natural air cooled bainitic steels in accordance with the invention over the current high strength pearlitic steel rails lies in the elimination of heat treatment operations during both the production of the rail and its subsequent joining by welding.

In another aspect, the invention provides a carbide-free bainitic steel rail produced by hot rolling to shape a steel whose composition by weight includes from 0.05 to 0.50% carbon, from 1.00 to 3.00% silicon and/or aluminium, from 0.50 to 2.50% manganese, from 0.25 to 2.50% chromium, from 0 to 3.00% nickel; from 0 to 0.025% sulphur; from 0 to 1.00% tungsten; from 0 to 1.00% molybdenum; from 0 to 3% copper; from 0 to 0.10% titanium; from 0 to 0.50% vanadium; and from 0 to 0.005% boron, balance iron and incidental impurities, the rail having been continuously cooled from its rolling temperature to ambient temperature naturally in air or by accelerated cooling.

The invention will now be described by way of example only with reference to the accompanying diagrammatic drawings:

BRIEF DESCRIPTION OF THE FIGURES OF DRAWINGS

DETAILED DESCRIPTION OF THE PREFERRED EMBODIMENT

Figure 1:
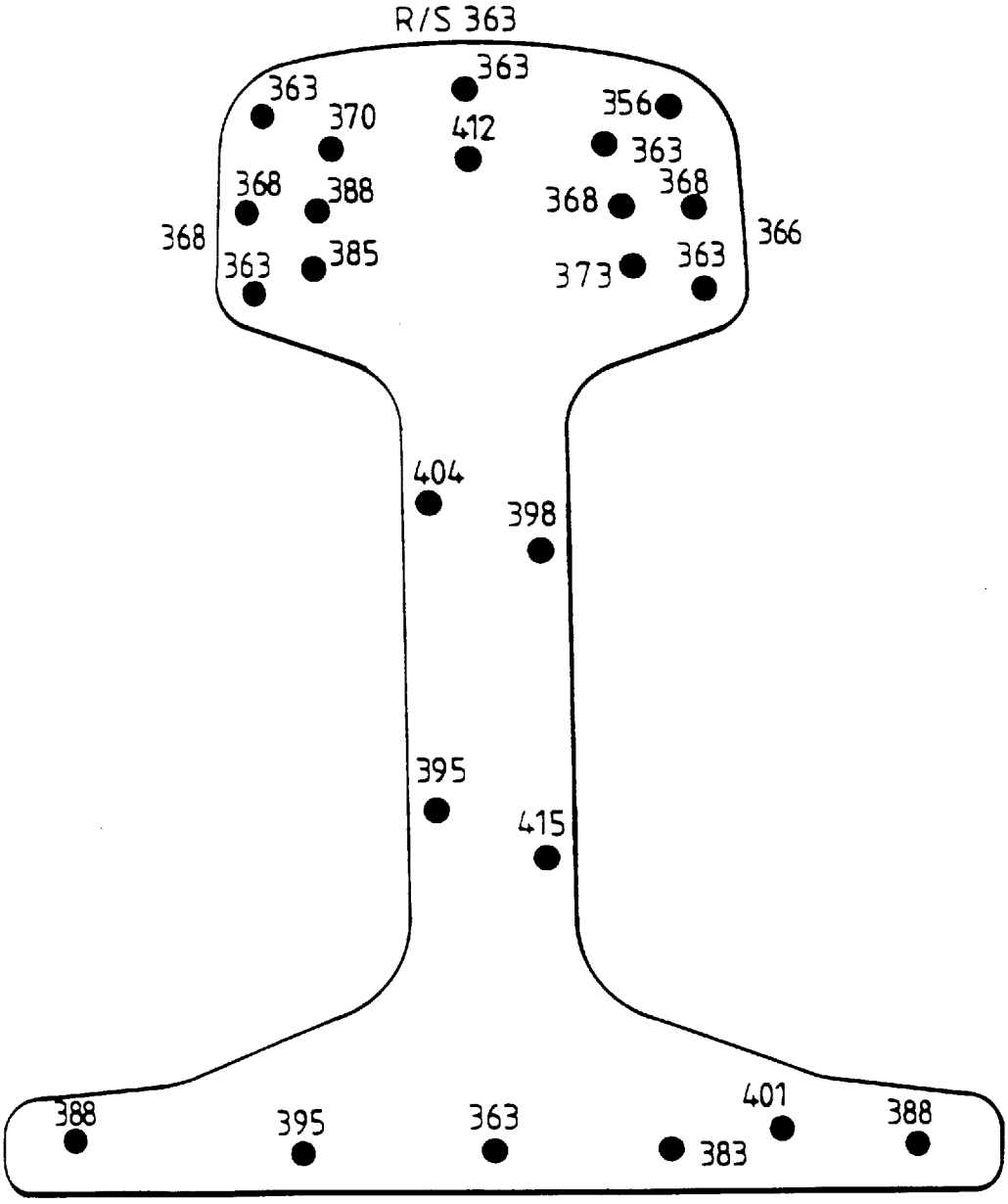
FIG. 1 illustrates a hardness profile of an iron carbide-free bainitic steel rail in accordance with the invention.

A primary objective of the present invention is to provide a high strength wear and rolling contact fatigue resistant microstructure comprising carbide free "bainite" with some high carbon martensite and retained austenite in the head of the rail. In practice, it has been found that this high strength microstructure is also present in both the rail web and foot regions of the as-rolled rail. A typical Brinell hardness (HB) profile for a 113 lb/yd rail section is shown in FIG. 1.

The high strength head, web and foot regions of the rail provide good rolling contact and bending fatigue performance during service in track.

This and other desired objectives are achieved by careful selection of the steel composition and by either continuously cooling the steel in air or accelerated cooling after hot rolling to ambient temperature.

Composition ranges for steels in accordance with this invention are set out in Table A below.

TABLE A

| Element | Composition Range (wt %) |
|---|---|
| Carbon | 0.05 to 0.50 |
| Aluminium/Silicon | 1.00 to 3.0 |
| Manganese | 0.05 to 2.5 |
| Nickel/Copper | up to 3.0 |
| Chromium | 0.25 to 2.5 |
| Tungsten | up to 1.0 |
| Molybdenum | up to 1.00 |
| Titanium | up to 0.10 |
| Vanadium | up to 0.50 |
| Boron | up to .0050 |
| Balance | Iron & Incidental Impurities |

Within the ranges, variations may be made depending on, inter alia, the hardness, ductility etc. required. All steels are however essentially bainitic in nature and are carbide free. Thus, the preferred carbon content may fall within the range 0.10 to 0.35% by weight. Also, the silicon content may be from 1 to 2.5% by weight, the manganese content from. 1 to 2.5% by weight, the chromium content from 0.35 to 2.25% by weight and the molybdenum content from 0.15 to 0.60% by weight.

Steels in accordance with the invention generally exhibit hardness values of between 390 and 500 Hv30, although it is also possible to produce steels with lower hardness levels. Typical hardness values, wear rates, elongation and other physical parameters can be seen from Table B appended hereto which identifies eleven sample steels in accordance with the invention.

Figure 2:
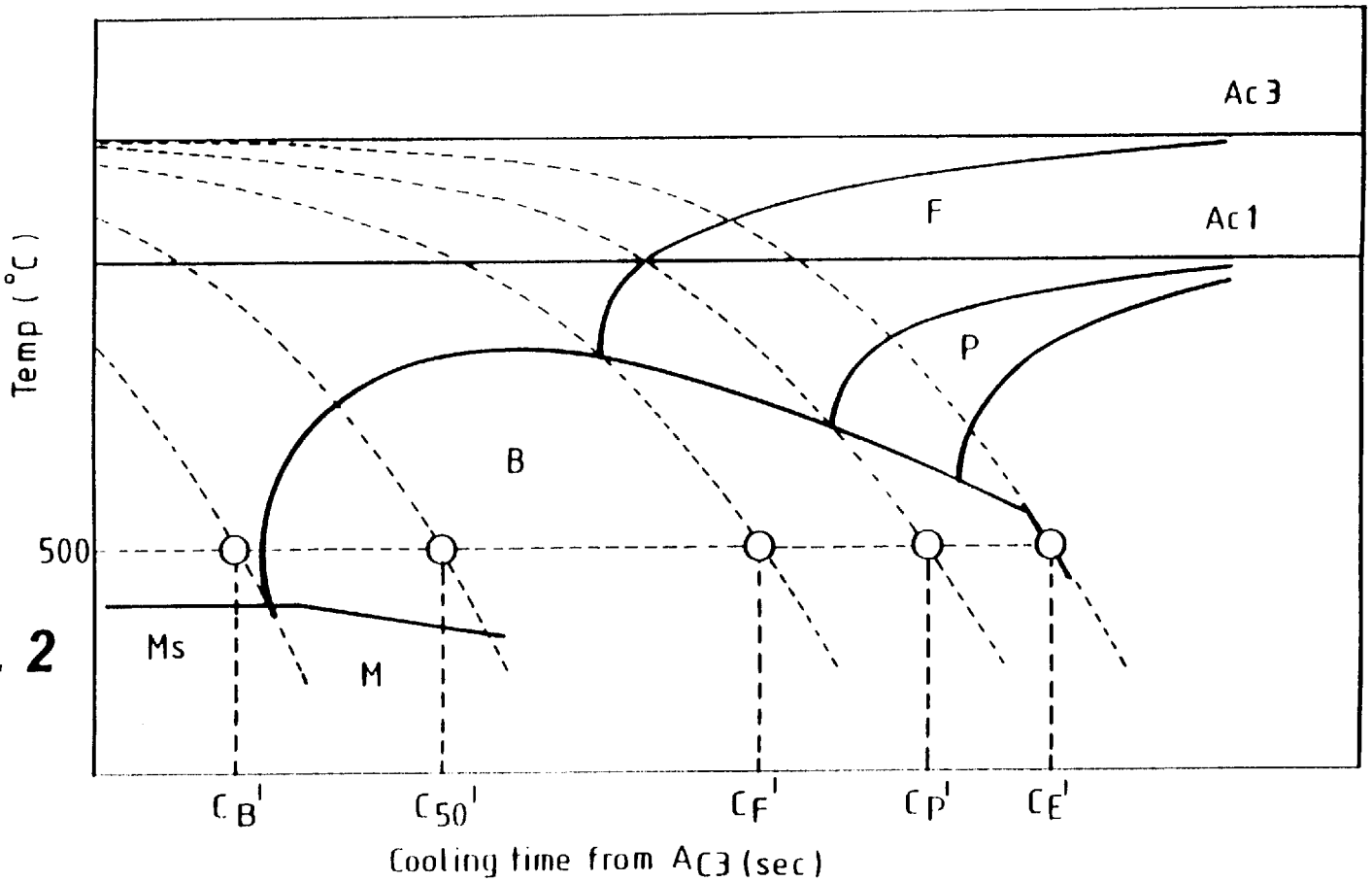
FIG. 2 is a schematic CCT diagram for a carbide-free bainitic steel in accordance with the invention.

FIG. 2 shows a schematic CTT diagram. The addition of boron serves to retard the transformation to ferrite, such that during continuous cooling, bainite forms over a wide range of cooling rates. In addition, the bainite curve has a flat top so that the transformation temperature is virtually constant over a wide range of cooling rates, resulting in only small variations in strength across relatively large, air cooled or accelerated cooled sections.

Figure 3:
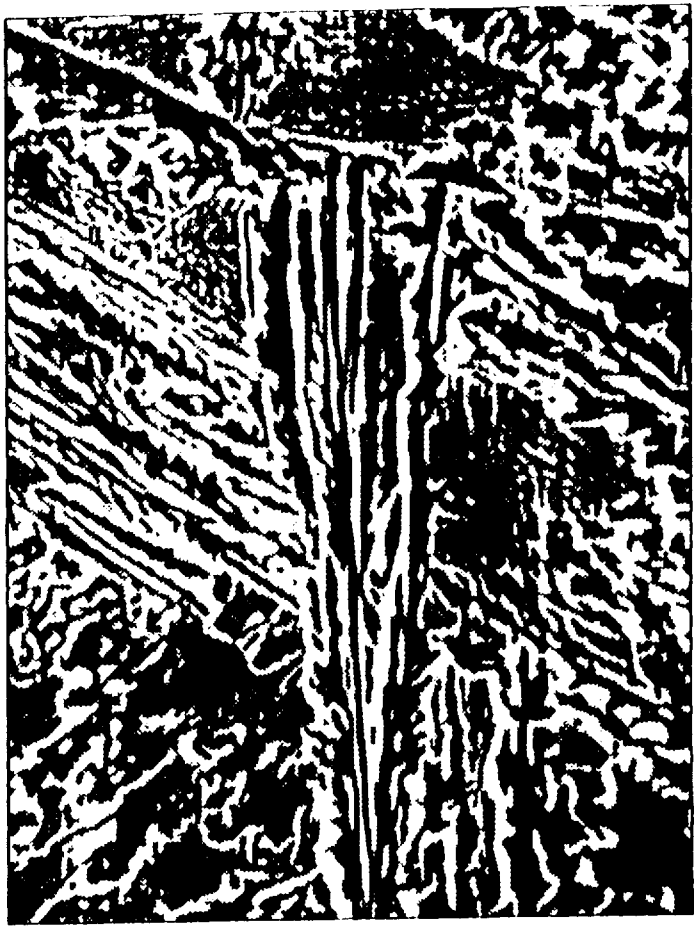
FIG. 3 is a scanning electron micrograph for a carbide-free bainitic steel in accordance with the invention.

The steels listed in Table B were rolled to 30 mm thick plates (cooling rates of 30 mm thick plate are close to those at the centre of a rail head), from −125 mm square ingots, and normal air cooled from a finish rolling temperature of ~1000° C. to ambient temperature. The as-rolled microstructures thereby developed comprise essentially a mixture of carbide free bainite, retained austenite with varying proportions of high carbon martensite as illustrated in FIG. 3.

A comparison of the range of mechanical properties achieved in the as-rolled, 30 mm thick experimental bainitic steel plates with those obtained typically for currently produced mill heat treated rails (MHT) is given below:

| Rail type | 0.2% PS ($N/mm^2$) | TS ($N/mm^2$ | E1 (%) | RofA (%) | HV30 | CVN(J) at 20° C. | $K_{1d}$ at −20° C. $MPcm^2$ | Wear Rate, mg/m of Slip (contact stress 750 $N/mm^2$ |
|---|---|---|---|---|---|---|---|---|
| MHT | 800–900 | 1150–1300 | 9–13 | 20–25 | 360–400 | 3–5 | 30–40 | 20–30 |
| Bainitic | 730–1230 | 1250–1600 | 14–17 | 40–55 | 400–500 | 20–39 | 45–60 | 3–36 |

Figure 4:
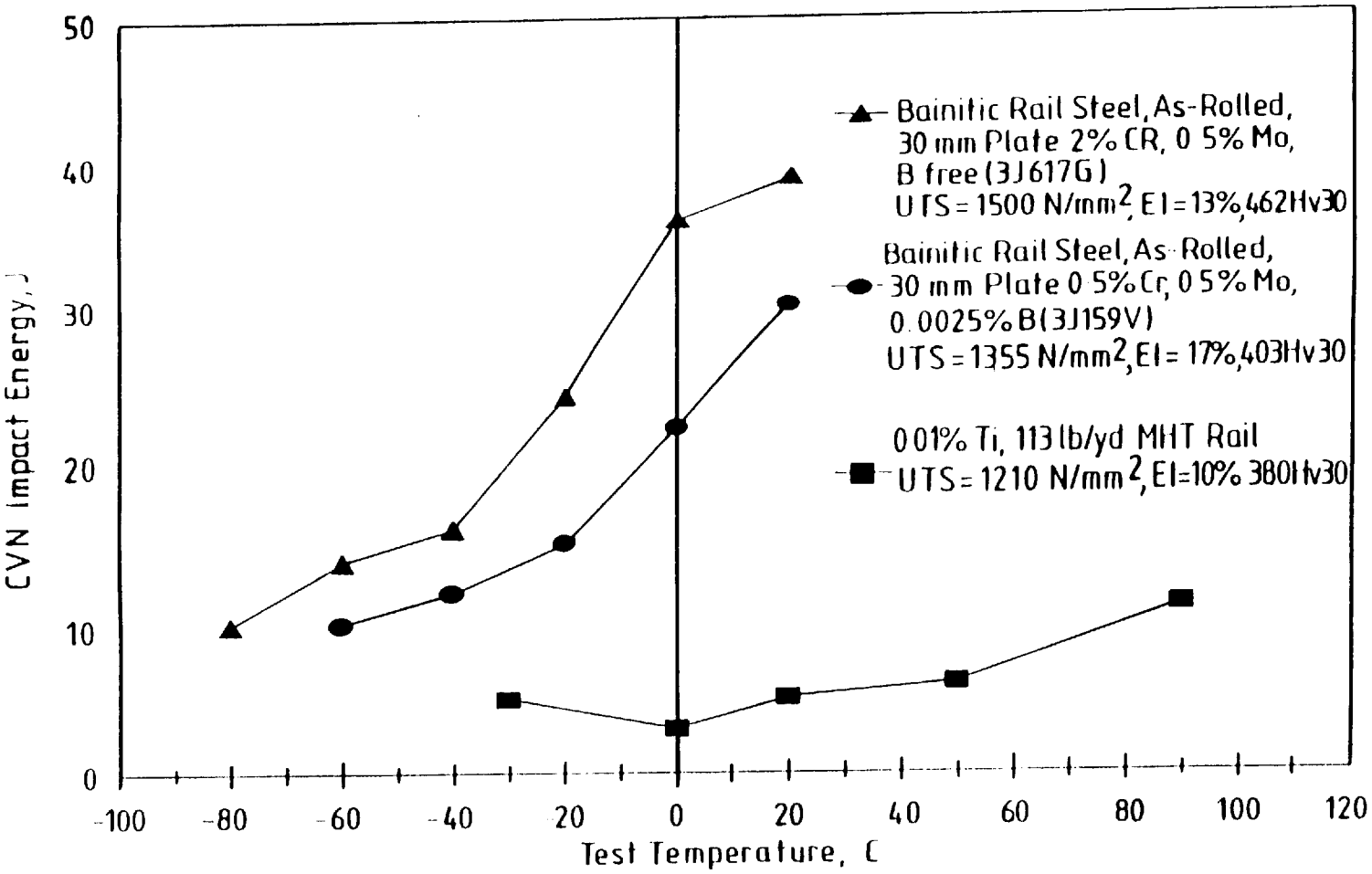
FIG. 4 show Charpy V-notch impact transition curves for, as-rolled, iron carbide-free bainitic steel in accordance with the invention compared with similar curves for plain carbon heat treated pearlitic steel used currently in railway track.

The properties of the as-rolled, 30 mm thick, bainitic steel plates represent a significant increase in strength and hardness levels compared with those of the heat treated pearlitic rail, accompanied by an improvement in the Charpy impact energy level from 4 to typically 35J at 20° C. Charpy V-notch impact transition curves for two of the as-rolled bainitic rail steel compositions (0.22%C, 2%Cr, 0.5%Mo, B free and 0.24%C, 0.5%Cr, 0.5%Mo and 0.0025%B) together with a plain carbon, mill heat treated, pearlitic rail, are shown in FIG. 4. The two bainitic rail steels can also be seen to retain high impact toughness down to temperatures as low as −60° C.

Figure 5:
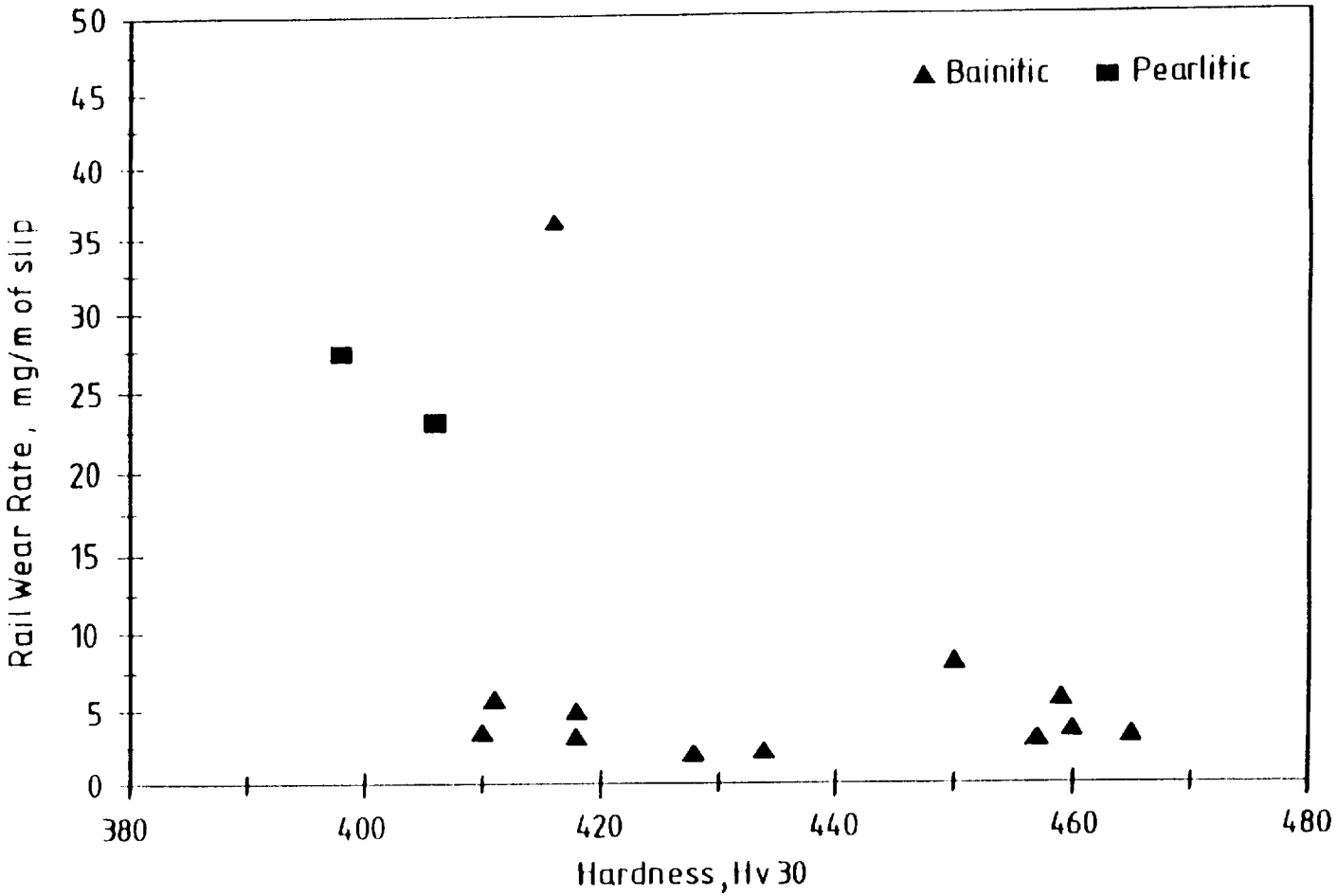
FIG. 5 is a graph of laboratory rolling contact wear rate against hardness of steel samples produced from carbide-free bainitic steels in accordance with the invention.

The laboratory rolling contact wear performance of the as-rolled, 30 mm thick bainitic steel plates under a contact stress of 750 $N/mm^2$ was established to be significantly better than that of the current pearlitic heat treated rails, as illustrated graphically in FIG. 5.

Figure 6:
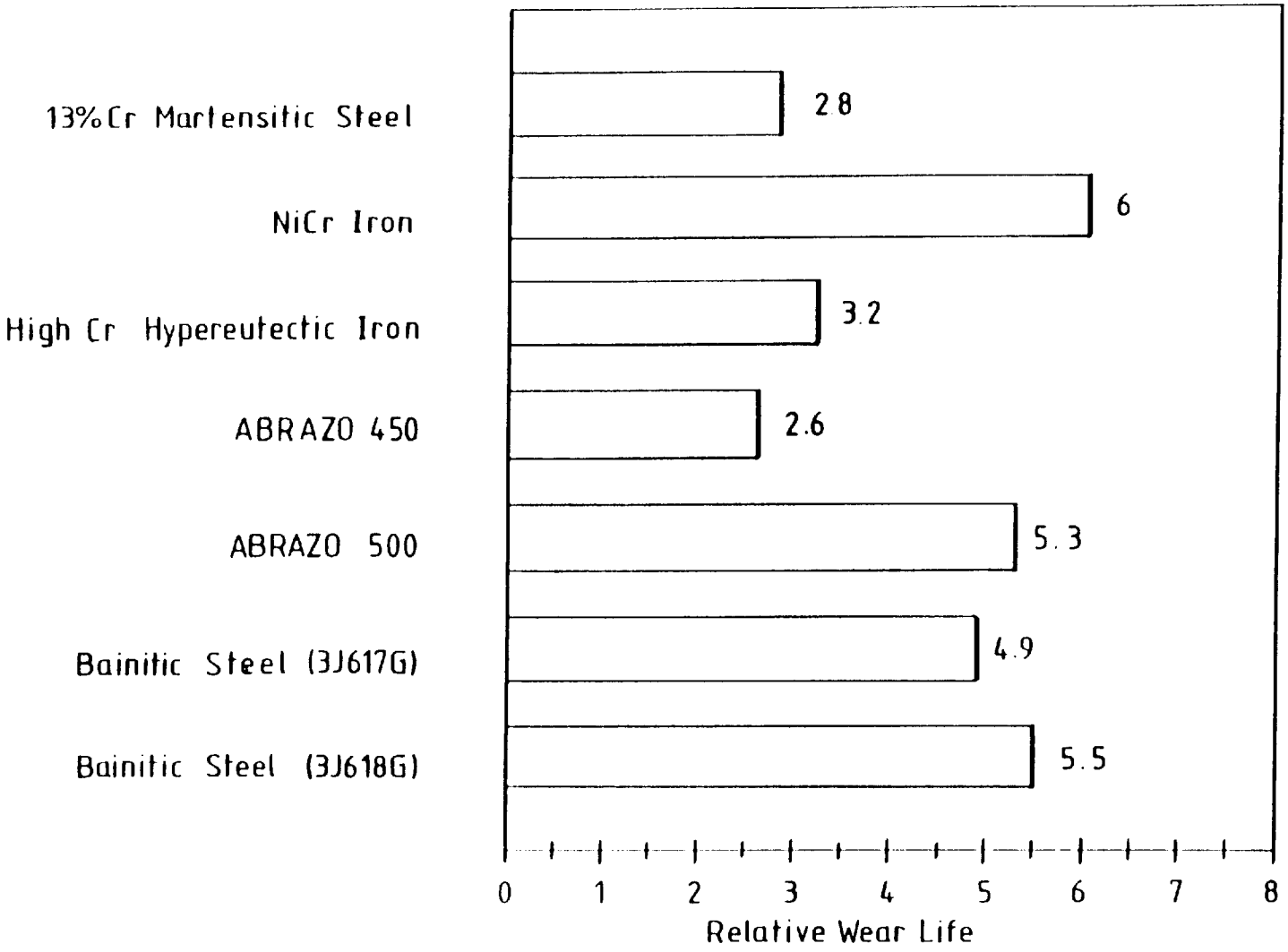
FIG. 6 illustrates abrasive wear lives of carbide-free bainitic steels in accordance with the invention and commercially available wear resistant materials against rounded quartz abrasive.

Tests carried out in relation to steels in accordance with the invention have also shown the bainitic steel compositions to offer a high resistance to wear under abrasive conditions, with relative wear lives of around 5.0 in comparison with a mild steel standard, against a rounded quartz aggregate. FIG. 6 shows that these wear life values are superior to those of many commercially available wear resisting materials, including Abrazo 450 and a 130%Cr martensitic steel.

The fracture toughness (resistance to the propagation of a pre-existing crack) of the as-rolled 30 mm thick bainitic steel plates has been found to be significantly higher at between 45 and 60 MPam½ in comparison with those of the heat treated pearlitic rails, with typical values in the range 30–40 MPam½.

Figure 7:
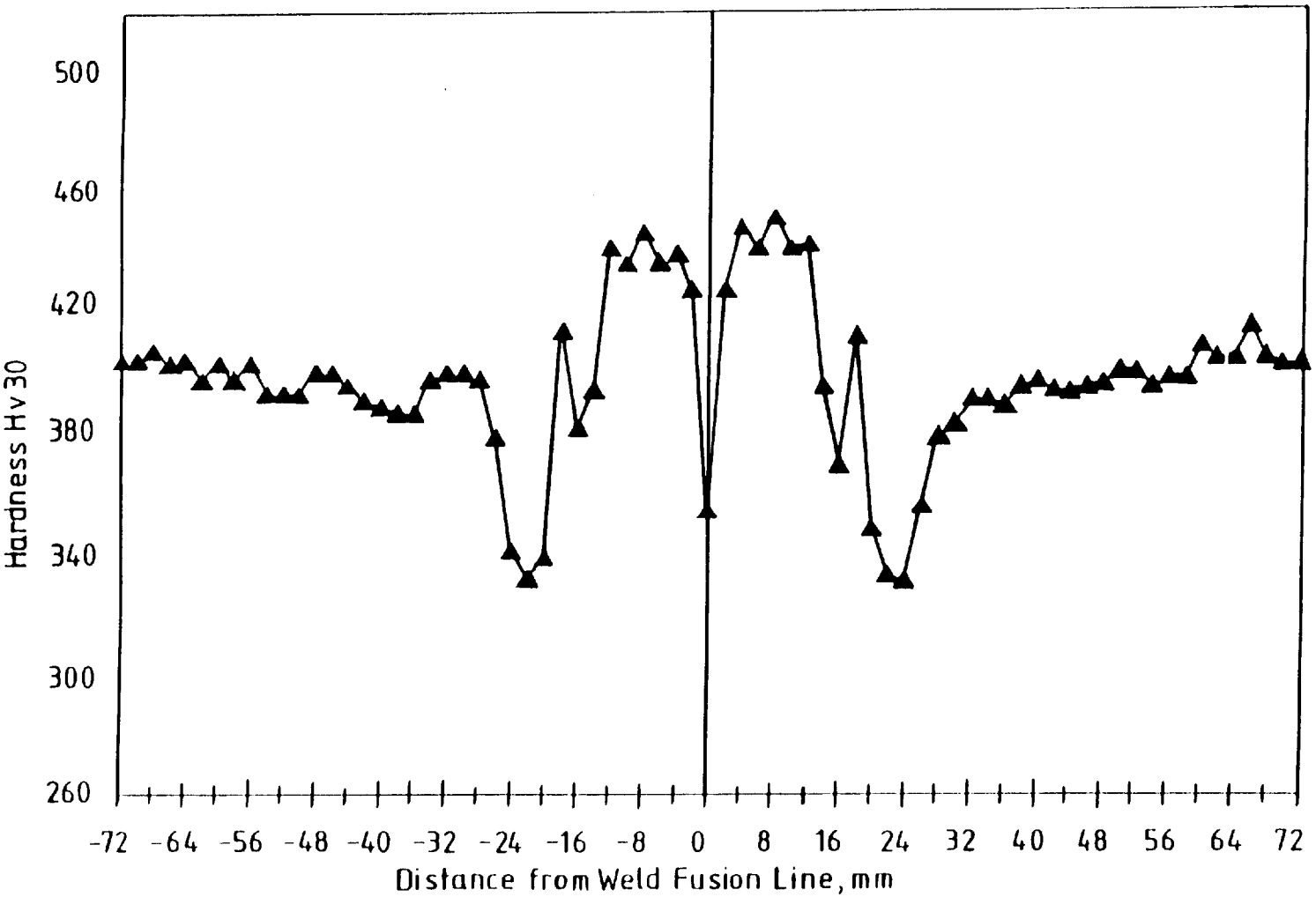
FIG. 7 is a graph showing a hardness profile of flash butt welded carbide-free bainitic steel plate in accordance with the invention.

The as-rolled, 30 mm thick steel plates were found to be readily flash butt weldable with hardness levels in the critical weld HAZ regions of normal air cooled, flash butt welded plates either matching, or slightly higher than, those of the parent plate material, as shown in FIG. 7.

Figure 8:
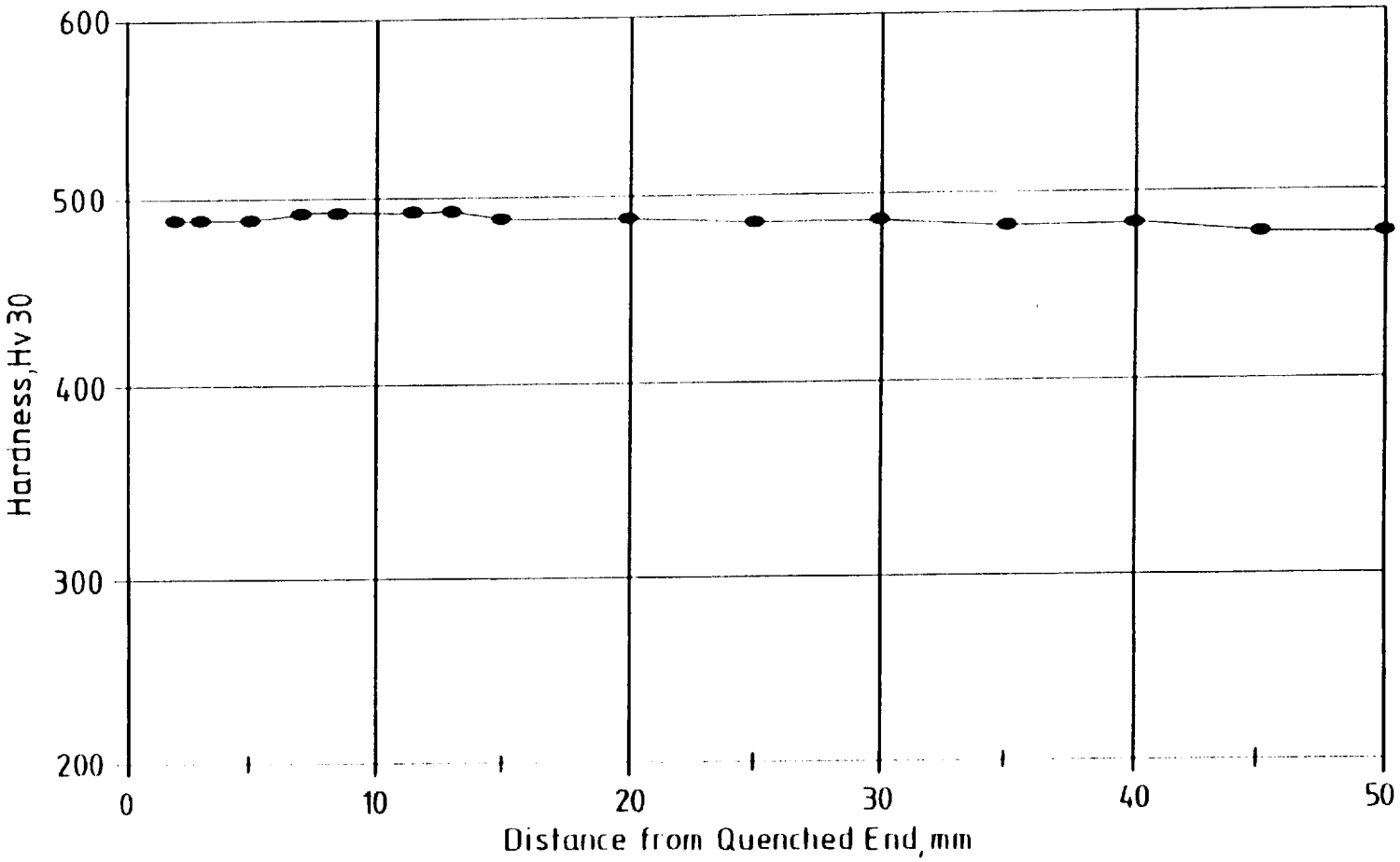
FIG. 8 is a jominy hardenability curve for as-rolled carbide-free bainitic steel in accordance with the invention.

The as-rolled, 30 mm thick experimental bainitic steel plates possessed high hardenabilities as illustrated in FIG. 8, with almost constant hardness levels being developed at distances of between 1.5 and 50 mm from the quenched end, corresponding to cooling rates at 700° C. of between 225° and 2° C./s.

We claim:

1. A method of producing a wear and rolling contact fatigue resistant carbide-free bainitic steel rail, the method comprising the steps of hot rolling to shape a steel whose composition by weight includes from 0.05 to 0.50% carbon, from 1.00 to 3.00% silicon and/or aluminum, from 0.50 to 2.50% manganese, from 0.25 to 2.50% chromium, from 0 to 3.00% nickel; from 0 to 0.025% sulphur; from 0 to 1.00% tungsten; from 0 to 1.00% molybdenum; from 0 to 3.00% copper; from 0 to 0.10% titanium, from 0 to 0.50% vanadium; and from 0 to 0.005% boron, balance iron and incidental impurities, and continuously cooling the rail from its rolling temperature to ambient temperature naturally in air or by accelerated cooling to produce the required wear and rolling contact fatigue resistant carbide-free bainitic steel rail.

2. A method as claimed in claim 1 wherein the carbon content of the rail is from 0.10 to 0.35% by weight.

3. A method as claimed in claim 1 wherein the silicon content is from 1.00 to 2.50% by weight.

4. A method as claimed in claim 2 wherein the silicon content is from 1.00 to 2.50% by weight.

5. A method as claimed in claim 1 wherein the manganese content is from 1.00% to 2.50% by weight, the chromium content is between 0.35 and 2.25% by weight and the molybdenum content is from 0.15 to 0.60% by weight.

6. A method as claimed in claim 2 wherein the manganese content is from 1.00% to 2.50% by weight, the chromium content is between 0.35 and 2.25% by weight and the molybdenum content is from 0.15 to 0.60% by weight.

7. A method as claimed in claim 3 wherein the manganese content is from 1.00% to 2.50% by weight, the chromium content is between 0.35 and 2.25% by weight and the molybdenum content is from 0.15 to 0.60% by weight.

8. A method as claimed in claim 4 wherein the manganese content is from 1.00% to 2.50% by weight, the chromium content is between 0.35 and 2.25% by weight and the molybdenum content is from 0.15 to 0.60% by weight.

9. A wear and rolling contact fatigue resistant carbide-free bainitic steel rail produced by hot rolling to shape a steel whose composition by weight includes from 0.05 to 0.50% carbon, from 1.00 to 3.00% silicon and/or aluminum, from 0.50 to 2.50%, manganese, from 0.25 to 2.50% chromium, from 0 to 3.00% nickel; from 0 to 0.025% sulphur; from 0 to 1.00% tungsten; from 0 to 1.00% molybdenum; from 0 to 3%copper; from 0 to 0.10% titanium; from 0 to 0.50% vanadium; and from 0 to 0.005% boron, balance iron and incidental impurities, the rail having been continuously cooled from its rolling temperature to ambient temperature naturally in air or by accelerated cooling.

* * * * *